United States Patent [19]

Kodet

[11] Patent Number: 5,072,534

[45] Date of Patent: Dec. 17, 1991

[54] DISPLAY SIGN HAVING COACTING DISPLAY ROLLERS AND DRIVE BELT ATTACHMENT

[76] Inventor: John Kodet, 139 Queens Rd., Connells Point, New South Wales 2221, Australia

[21] Appl. No.: 498,701

[22] Filed: Mar. 26, 1990

[51] Int. Cl.[5] ..... G09F 11/12

[52] U.S. Cl. ..... 40/524; 40/438

[58] Field of Search ..... 40/624, 487, 486, 493, 40/502-508, 514, 515, 517-525, 601, 423, 429, 436-438, 470-472, 116, 117, 526-528, 385; 446/82, 8; 272/8 N, 8 D, 9, 11

[56] References Cited

U.S. PATENT DOCUMENTS

| | | | |
|---|---|---|---|
| 537,441 | 4/1895 | Demmon | 446/82 |
| 3,213,566 | 10/1965 | Mickler | 40/472 |

FOREIGN PATENT DOCUMENTS

| | | | |
|---|---|---|---|
| 2242444 | 3/1973 | Fed. Rep. of Germany | 40/578 |
| 3624123 | 1/1988 | Fed. Rep. of Germany . | |
| 401484 | 7/1909 | France | 40/472 |
| 549441 | 2/1956 | Italy . | |
| 413053 | 8/1934 | United Kingdom . | |
| 925681 | 5/1963 | United Kingdom . | |
| 1096567 | 12/1967 | United Kingdom | 40/472 |
| 1370369 | 10/1974 | United Kingdom . | |

*Primary Examiner*—Kenneth J. Dorner
*Assistant Examiner*—James M. Gardner

[57] ABSTRACT

A sign for alternately exhibiting two different displays. The sign comprises a display face, a pair of belts which carry the display material and two rollers which are mounted to a carriage for travel back and forth across the sign face. The belts are secured at one end to opposite sides of the sign face and at the other end wind around respective rollers. In operation the belts wind onto or off their respective rollers as the carriage travels back and forth on a rail across the sign to sequentially exhibit for view or conceal the display material on each belt. The drive mechanism for the carriage comprises an endless cable or belt running between pulleys at each end of the rail and attaching to a slide mechanism on the carriage.

1 Claim, 8 Drawing Sheets

DISPLAY SIGN HAVING COACTING DISPLAY ROLLERS AND DRIVE BELT ATTACHMENT

BACKGROUND OF THE INVENTION

This invention relates to sign displays and more particularly although not exclusively to changeable exhibits for advertising or other information disseminating purposes.

While there are many known types of changeable display signs these normally require the extensive use of electronic gadgetry. The capital cost of such signs is therefore high as are the running expenses due to their considerable energy consumption.

SUMMARY OF THE INVENTION

It is therefore an object of this invention to ameliorate the aforementioned disadvantages and accordingly this invention discloses a sign comprising at least one belt for carrying display material and at least one roller means which is adapted for movement across the face of said sign wherein the belt is disposed to wind over the roller means as it moves across said face so that said display material is progressively exhibited for view or concealed in accordance with the direction of travel of said rollers.

BRIEF DESCRIPTION OF THE DRAWINGS

The currently preferred forms of this invention will now be described with reference to the attached drawings in which.

DETAILED DESCRIPTION OF THE INVENTION

Figure 1:
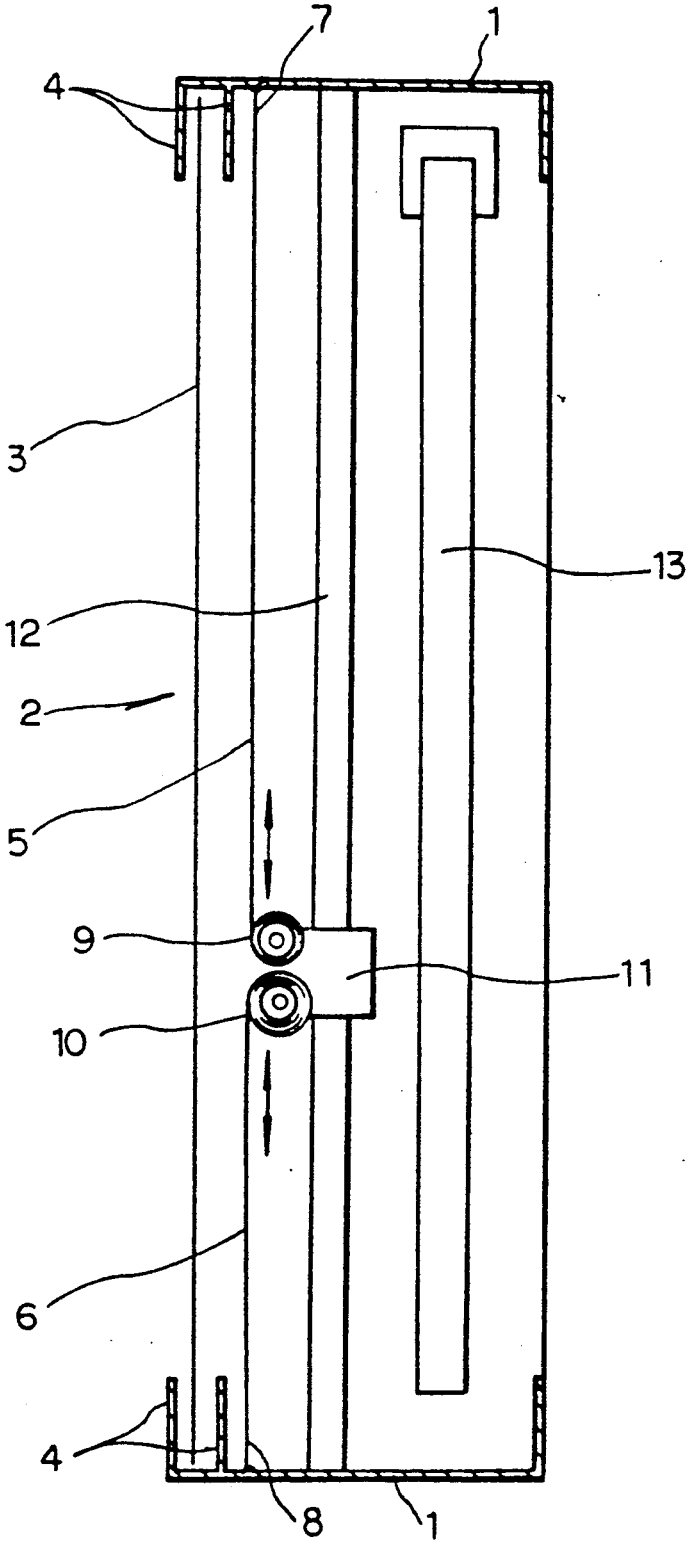
FIG. 1 shows a schematic cross-sectional view of one form of sign according to this invention.

Referring first to FIG. 1 the sign may comprise a frame 1 with an open display area or face 2 on one side. Preferably the display face is sealed against the ingress of dust or moisture by a sheet of transparent plastic or glass 3 which sits between flanges 4 at each end. Immediately behind the sheet 3 a pair of belts 5 and 6 are extended across the display area. Although it is not apparent from this sectional view the belts have sufficient width in the direction perpendicular to the plane of the drawing to allow the exhibition of graphic material.

Each of the belts are secured to a respective frame section of the sign at one end 7 and 8, and at the other end they wind around rollers 9 and 10. These rollers are spring loaded to maintain the belts in a substantially taut and crease free configuration so that the display is presented to best advantage. The rollers are mounted on a carriage 11 which in turn is adapted to travel back and forth along a rail 12 from one side of the display face to the other. Although not shown in the drawings the carriage may for example be propelled by a small onboard motor or by a system of pulleys and cables from a stationary motor as described later. To illuminate the sign face the belt material may at least in part be translucent and a light tube 13 may be mounted along the back face of the sign frame.

Figure 2:
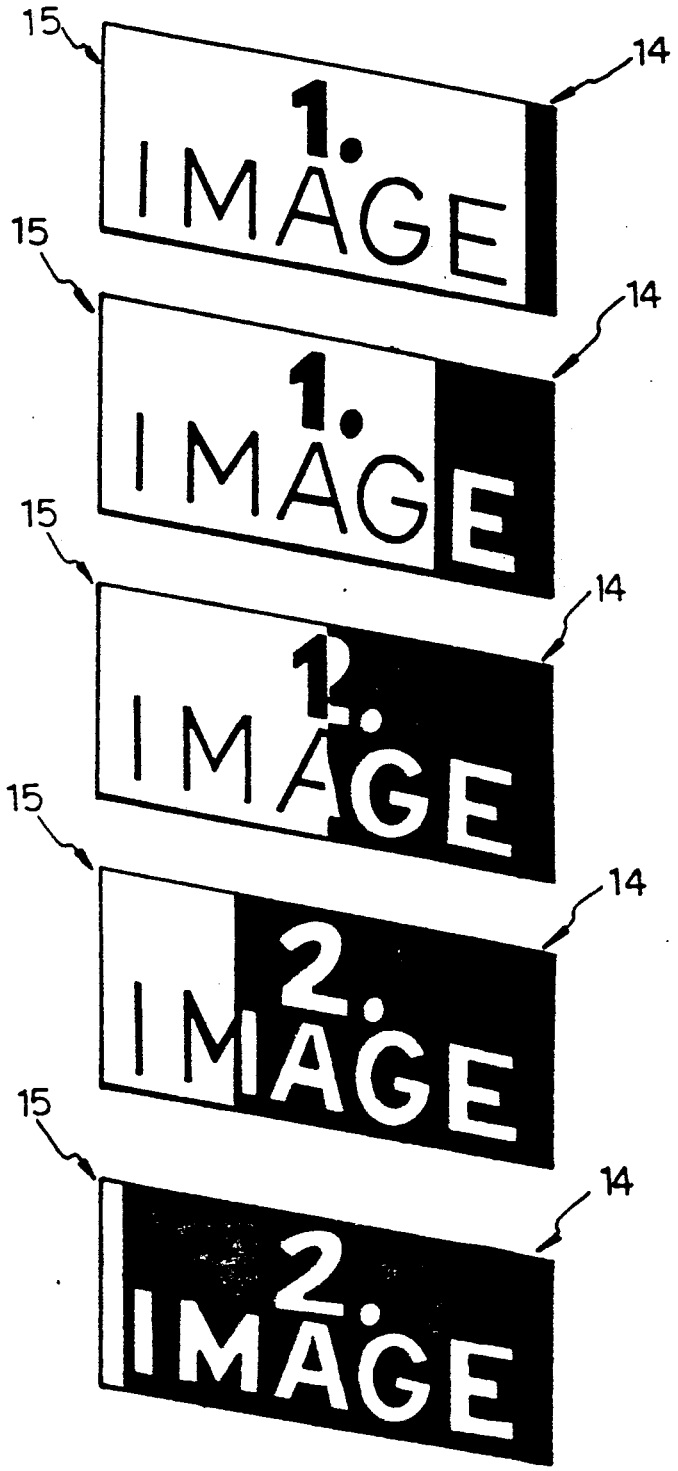
FIG. 2 shows an example of the type of animation which may be obtained from this sign.

An example of the effect produced by the sign is shown in FIG. 2. When the roller carriage is adjacent one side 14 of the display face the graphics carried by the unwound belt are clearly displayed. However as the carriage moves towards the other side 15 this material is progressively concealed from view as it winds onto its respective roller and is replaced by the graphics on the second unwinding belt. The result of this arrangement is that two completely independent images can be displayed on the same sign face. Each in turn is displayed in its entirety and then smoothly merged into the other as the carriage is moved across the sign face.

Two embodiments of mechanisms for driving carriage 11 are shown in the drawings.

Figure 2A:
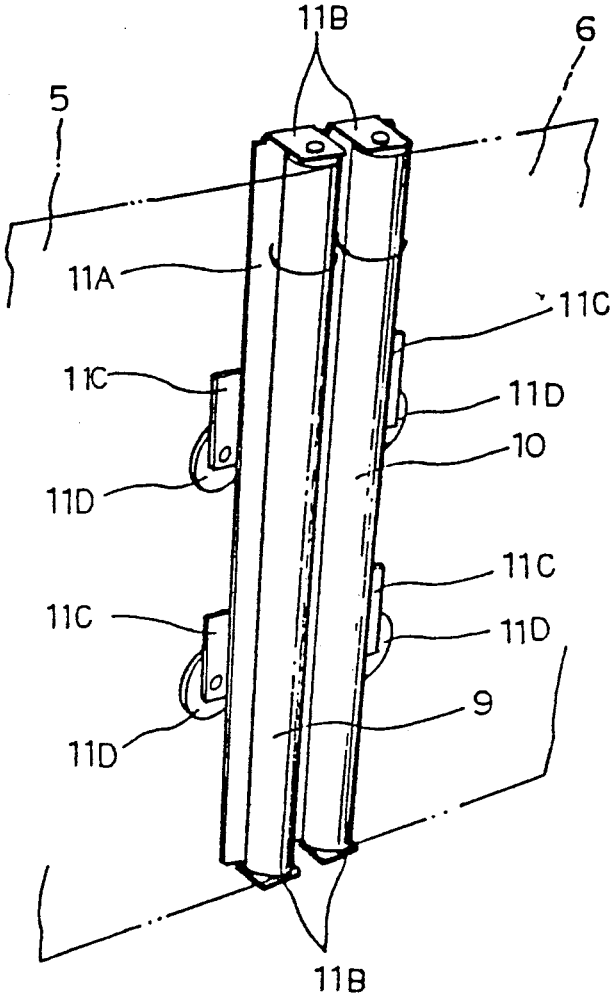
FIGS. 2A, 2B, and 2C show the preferred form of carriage, rail and drive mechanism for the sign illustrated schematically in FIG. 1.
Figure 2D:
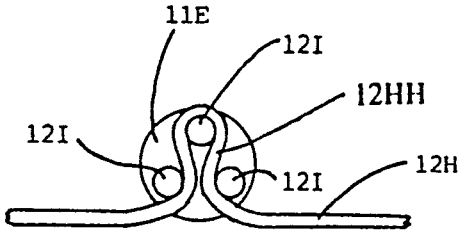
FIG. 2D shows an alternative form of drive mechanism using a belt.
Figure 2B:
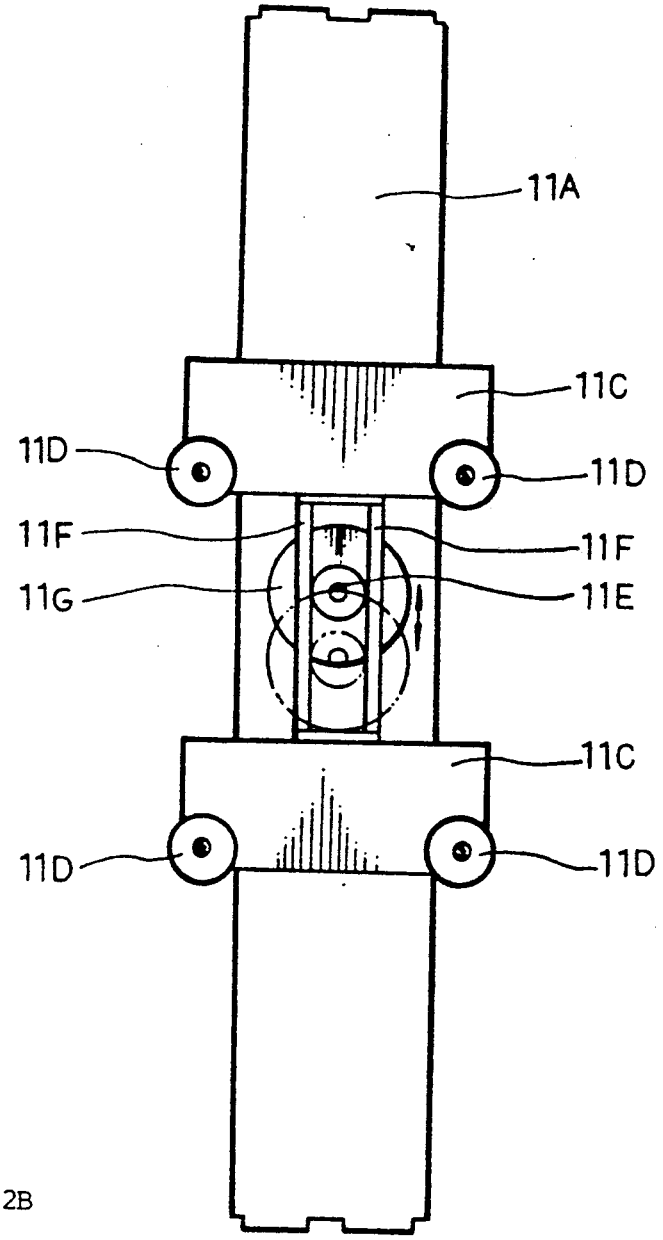
Figure 2C:
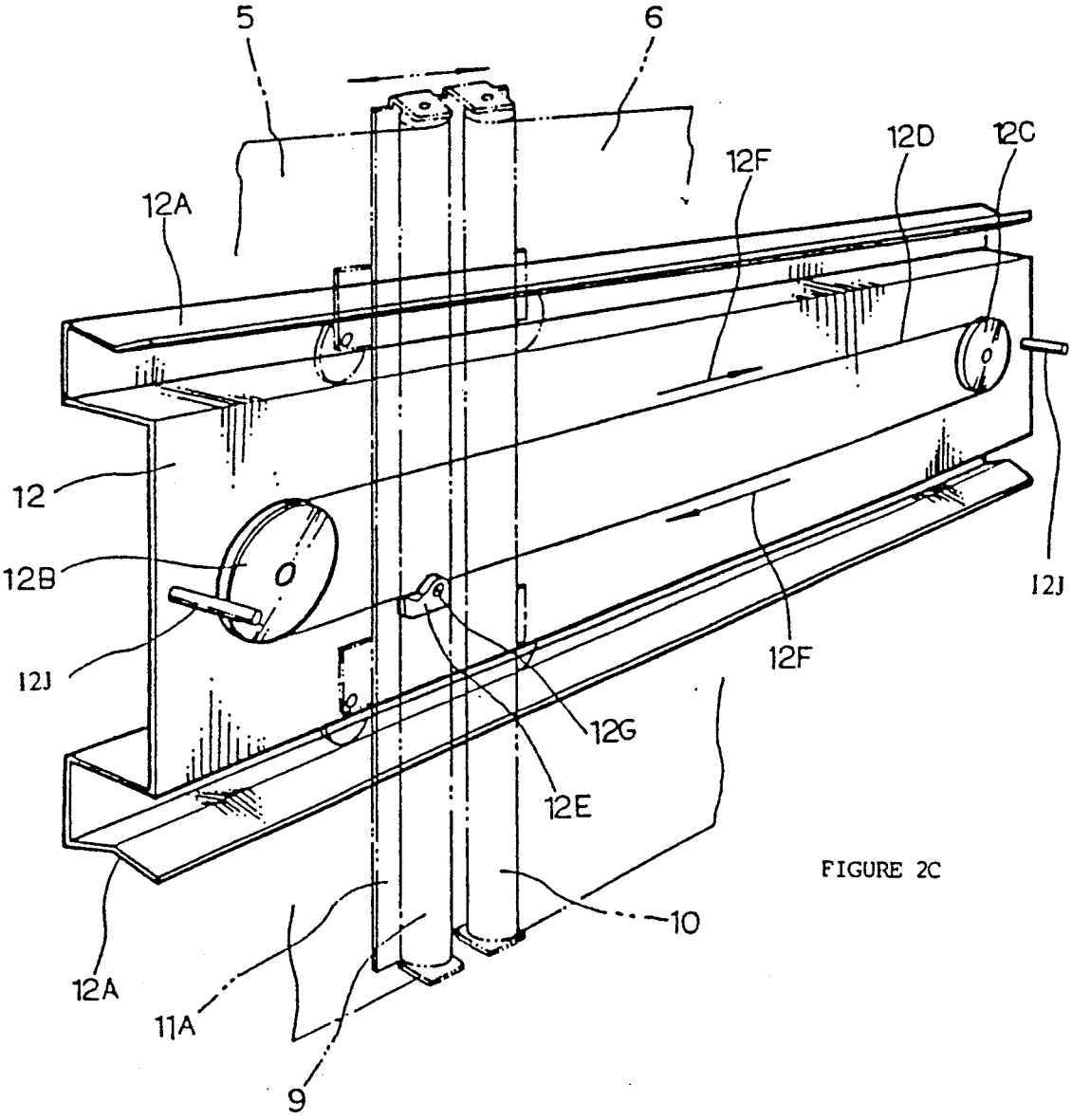

FIG. 2C shows the first embodiment comprising a pair of pulleys 12B and 12C that have an endless drive cable 12D mounted around pulleys 12B and 12C. As the pulleys are rotated by a motor (not shown) the pulleys propel endless drive cable 12D around the pulleys in the direction indicated by arrows 12F.

As an alternate embodiment the drive cable can be replaced with a drive belt. The drive belt is identified as 12H in FIG. 2D.

In order to translate the rotational motion of drive cable 12D to the back and forth motion of carriage 11A I provide a clip 12E that is secured to drive cable 12H. Clip 12E engages a drive mechanism on the back of carriage 11 to propel carriage 11 back and forth.

In operation of the embodiment using clip 12E, clip 12E is fastened to the drive cable 12D by means not shown. FIG. 2C shows that pulleys 12B and 12C have an open face so that clip 12E can remain fastened to cable 12D as one rotates cable 12D in a clockwise direction about the pulleys. Thus clockwise rotation of cable 13D drives clip 12E horizontally toward pulley 12B. As clip 12E follows cable 12D around pulley 12B clip 12E continues to move horizontally as clip 12E moves vertically upward around pulley 12B. As the clip 12E passes around pulley 12B clip 12E continues to move vertically upward but eventually begins to move in the opposite horizontal direction toward pulley 12C.

Referring to FIG. 2B the back of carriage 11 is shown revealing the carriage drive mechanism for engaging clip 12E. The carriage drive mechanism includes two bars 11F with a lug 11E protruding through bars 11F to engage clip 12E. Attached to lug 11E and located behind bars 11F is a disk 11G that moves up and down with lug 11E as indicated by the phantom lines and arrow in FIG. 2B. The bars 11F permit lug 11E to move up and down while preventing lateral displacement of the lug 11E between bars 11F. Consequently, as clip 12E engages lug 11E the up and down motion of clip 12E as it passes in a clockwise direction around pulley 12B causes the protruding lug 11E to move from the bottom position illustrated by the phantom lines to the top position indicated by the solid lines in FIG. 2B. When clip 12E passes around pulley 12C the opposite action occurs as lug 11E moves from the top position indicated by the solid lines in FIG. 2B to the lower position indicated by the phantom lines. Consequently, the horizontal displacement of clip 12E and interaction of clip 12E with the drive mechanism on the back of carriage 11 causes the carriage to move back and forth thereby changing the display image.

FIGS. 2A, 2B and 2C show in greater detail the currently preferred embodiment of the aforementioned carriage and rail. The carriage comprises an elongated chassis 11A with pairs of flanges 11B at each end which rotatably hold the rollers 9 and 10. Transverse bars 11C are located across the back of the carriage (as shown in FIG. 2B) and these mount sets of wheels 11D. The vertical spacing of these wheels is such that they run within upper and lower channels 12A in the outer flanges of the U shaped rail member 12 (see FIG. 2C). The drive mechanism for the carriage preferably consists of a pair of pulleys 12B and 12C with an endless drive cable or belt running between them. One of the pulleys is driven from a stationary motor so that this cable or belt continuously traverses the length of the rail in the direction shown by arrows 12F.

In the case of a drive cable (shown as 12D in FIG. 2C) there is an attached clip 12E which is attached to the cable and travels its path of motion along the length of the rail and around the pulleys 12B and 12C. This clip 12E has an aperture 12G therein which fits over a lug 11E fitted to the back of the carriage chassis 11A.

In the case of a drive belt (shown as 12H in FIG. 2D) a section 12HH of this belt fits directly onto the protruding lug 11E by passing between three fingers 12I which with this embodiment are located on the lug. This drive belt alternative eliminates the need for the clip 12E.

The movement of the clip 12E or section 12HH of belt as it traverses back and forth across the sign face is thus transferred to the carriage to operate the sign as described earlier. To accommodate the vertical displacement of the clip 12E or belt section 12HH as it rounds the pulleys at each end of the rail this lug 11E is mounted in a slide on the carriage chassis formed by two parallel bars 11F arranged perpendicular to the direction of travel of the carriage and a disk 11G. More specifically the lug 11E extends between the two bars 11F and attaches to the disk 11G located behind. The lug 11E is a sliding fit between these bars so that only horizontal movement is transferred to the carriage (in the orientation shown by FIG. 2B) while any vertical movement of the lug 11E is taken up by the slide.

The aforementioned anchorages 7 and 8 of FIG. 1 may be formed by pins 12J protruding out from each side of the rail.

Figure 3:
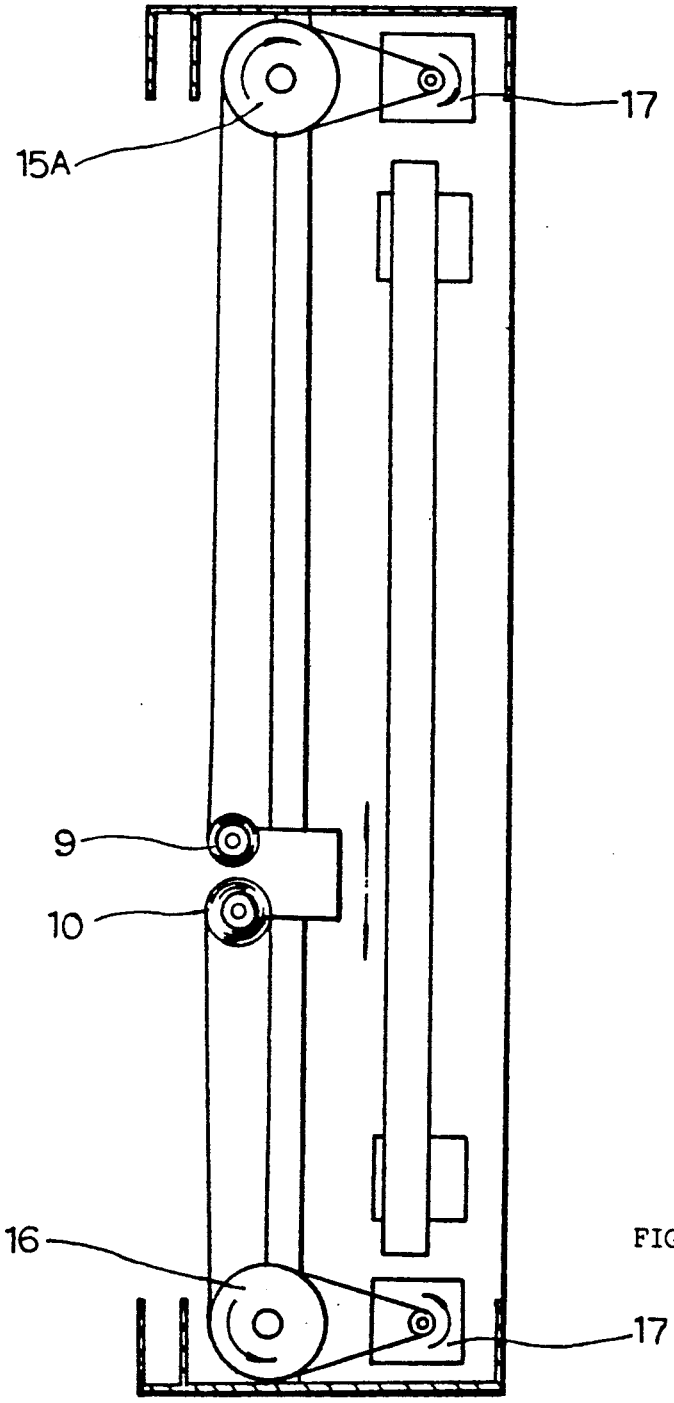
FIG. 3 shows a schematic view of a modification to the sign of FIG. 1.

A modification of the embodiment of FIG. 1 is shown in FIG. 3. The basic mechanism here is similar except that additional rollers 15A and 16 are provided at each end of the display area to increase the length of the belts and thus the amount of material that can be displayed thereon. By changing the segment of each belt that is unwound across the sign face between the carriage rollers 9 and 10, and the respective outer rollers 15A and 16 the combination of images displayed can be readily varied. With this particular example stationary motors 17 are shown at each end of the sign frame which drive the rollers 15A and 16 to move the carriage across the sign face.

Figure 4:
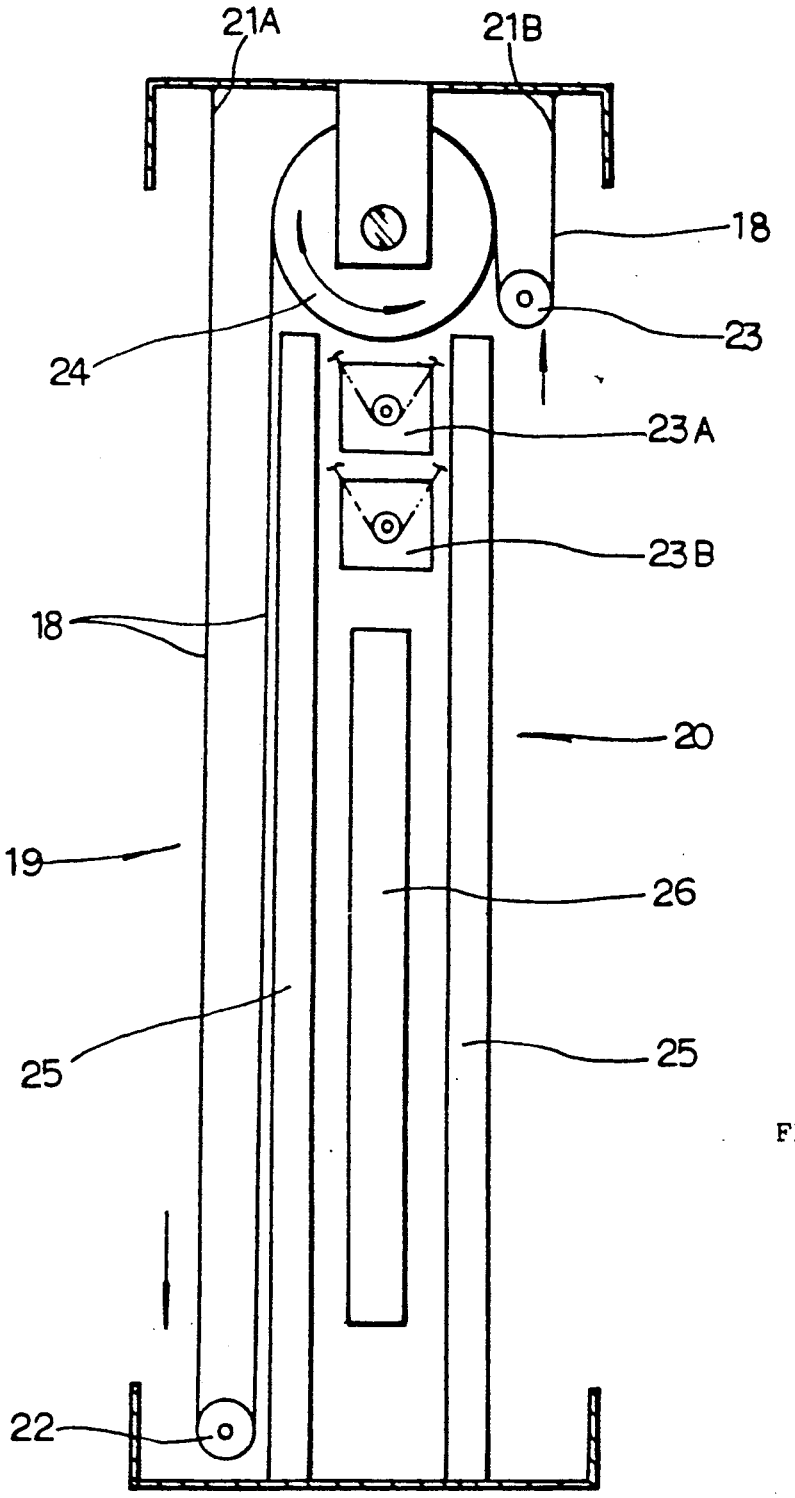
FIG. 4 shows a schematic cross-sectional view of a second embodiment of this invention.

FIG. 4 shows a second embodiment of the invention in which the sign is adapted to use only one continuous belt 18 to display on two opposite faces 19 and 20. Both ends 21A and 21B of the belt are affixed to the top end of the sign frame and the section therebetween extends around two horizontal rollers 22 and 23, and a central drive roller 24. The sign is intended to operate in the vertical orientation shown so that the weight of rollers 22 and 23 serves to tension the display area of the belt without the assistance of springs. Any suitable type of reversible motor drive 23A and 23B may be used to rotate roller 24 so that lengths of belt 18 with suitable graphics thereon are displayed alternately on each of the sign faces 19 and 20. Transparent background displays 25 are also located on each side of the central light fixture 26 which are alternately overlayed by the graphics on the belt to produce an effect similar to that described earlier with reference to FIG. 2.

Figure 5:
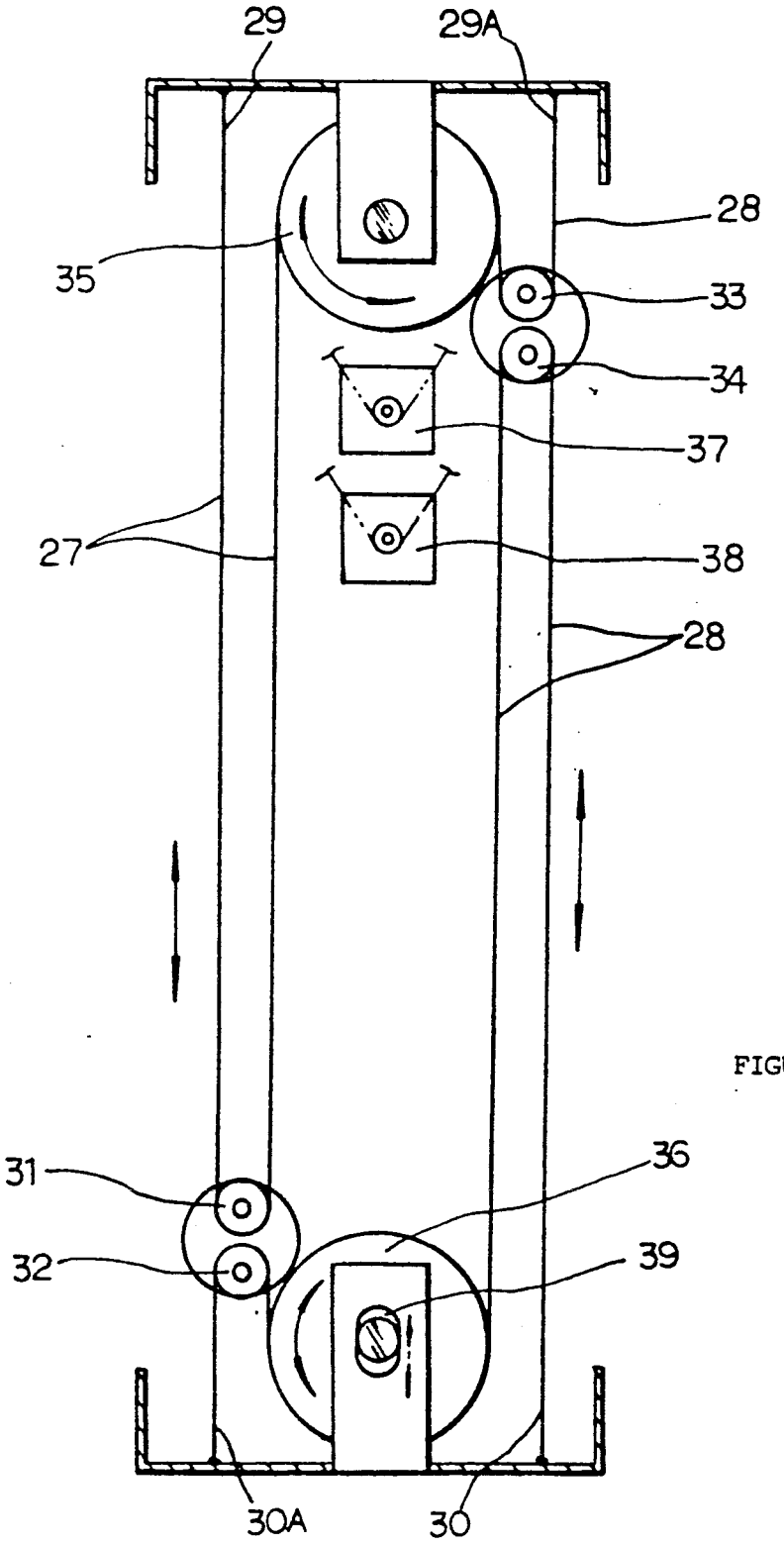
FIG. 5 shows a schematic cross-sectional view of a third embodiment of this invention.

A modification of the sign of FIG. 4 is shown in FIG 5. In this case two separate belts 27 and 28 are used so that the background display can be omitted. The belts are arranged in a similar manner to that of FIG. 4 with the ends 29, 29A and 30, 30A being secured to the top and bottom respectively of the sign frame and the mid-sections extending around pairs of horizontal rollers 31, 32, 33, 34 and central rollers 35 and 36. The upper roller 35 is rotated by a reversible motor drive 37 and 38, and it thereby displaces belt 27 in an identical manner to the device of FIG. 3. Each pair of adjacent horizontal rollers 31-32 and 33-34 are mechanically linked so that the displacement of the upper belt 27 causes a corresponding movement in lower belt 28. Roller 36 is also preferably mounted in a slotted aperture 39 so that it's weight serves to tension the belts and prevent creasing of the display. The effect of this arrangement is that an animated exhibit is produced on each side of the sign which is similar to that of FIG. 2.

It will thus be appreciated that this invention at least in the form of the embodiments described provides a novel, unique and low cost construction for animated signs. Clearly however the examples disclosed are only the currently preferred forms of this invention and a wide variety of modifications may be made which would be apparent to a man skilled in the art. For example the apparatus for driving the rollers may comprise any suitable kind of electrical, mechanical or hydraulic arrangement. Further, the invention is not limited to any particular material for constructing the belts or the other components of the sign.

What is claimed is:

1. A sign comprising:

a display face;

a pair of display belts which carry display material;

a rail member extending from one side of the display face to the other;

a carriage which travels along said rail member, said carriage having a front and a back, said back of said carriage having two parallel bars;

a disk;

a lug having fingers, said lug mounted on said disk, said disk being constrained to slide between said two parallel bars on the back of said carriage, said parallel bars arranged perpendicular to the direction of movement of said carriage along said rail member;

a drive mechanism for said carriage comprising an endless belt which runs between a pair of pulleys, located at opposite ends of said rail member, said endless belt engaging said lug by passing between said fingers on said lug so that rotation of said endless belt propels said carriage across said display sign while allowing said lug to move vertically between said parallel bars when lug passes around each of said pulleys; and two rollers which during operation of the sign remain mounted on said carriage which travels back and forth across said display face, each of said display belts being secured at one end to respective fixed anchorages at opposite sides of said display face and at the other end, connect with and wind around respective ones of said rollers, whereby said display belts wind onto or off their respective rollers as the carriage travels back and forth across said face to continuously and sequentially exhibit for view or conceal the display material on each of said display belts.

* * * * *